US005715363A

United States Patent [19]

Tamura et al.

[11] Patent Number: 5,715,363

[45] Date of Patent: Feb. 3, 1998

[54] METHOD AND APPARATUS FOR PROCESSING SPEECH

[75] Inventors: Junichi Tamura, Tokyo; Atsushi Sakurai; Tetsuo Kosaka, both of Yokohama, all of Japan

[73] Assignee: Canon Kabushika Kaisha, Tokyo, Japan

[21] Appl. No.: 443,791

[22] Filed: May 18, 1995

Related U.S. Application Data

[63] Continuation of Ser. No. 73,981, Jun. 8, 1993, abandoned, which is a continuation of Ser. No. 599,882, Oct. 19, 1990, abandoned.

[30] Foreign Application Priority Data

Oct. 20, 1989 [JP] Japan ..... 1-274638

[51] Int. Cl.[6] ..... G10L 3/02

[52] U.S. Cl. ..... 395/2.14; 395/2.09; 395/2.12

[58] Field of Search ..... 395/2, 2.1, 2.12–2.18, 395/2.3–2.32, 2.77; 381/29–40, 51–53; 364/724.15–724.17

[56] References Cited

U.S. PATENT DOCUMENTS

| | | | |
|---|---|---|---|
| 3,681,530 | 8/1972 | Manley et al. | 381/32 |
| 4,260,229 | 4/1981 | Bloomstein | 395/2.44 |
| 4,882,754 | 11/1989 | Weaver et al. | 381/35 |
| 4,922,539 | 5/1990 | Rajasekaran et al. | 381/39 |
| 5,056,143 | 10/1991 | Taguchi | 395/2.3 |

FOREIGN PATENT DOCUMENTS 0388104 9/1990 European Pat. Off. .

OTHER PUBLICATIONS

Oppenheim et al., "Computation P Spectra with Unequal Resolution Using the Fast Fourier Transform," Poc. of the IEEE, Feb. 1971, pp. 342–343 (from original pp. 299–301).

Flanagan, "Speech Analysis Synthesis and Perception, Second Edition", New York 1972, Springer–Verlag, pp. 184–185.

"Speech Analysis Synthesis System and Quality of Synthesized Speech Using Mel–Cepstrum" Electronics and Communications in Japan, vol. 69, No. 10, Oct. 1, 1986, New York US; pp. 957–964.

"Cepstral Analysis Synthesis on the Mel Frequency Scale", International Conference on Acoustics Speech and Signal Processing, vol. 1, Apr. 14, 1983, Boston, Massachusetts, pp. 93–96.

"Vector Quantization of Speech Signals Using Principal Component Analysis", Electronics and Communications in Japan, vol. 70, No. 5, May, 1, 1987 New York US, pp. 16–25.

*Primary Examiner*—Kee M. Tung

*Attorney, Agent, or Firm*—Fitzpatrick, Cella, Harper & Scinto

[57] ABSTRACT

The speech processing apparatus and method includes a microphone, an analyzer, a selector, and a memory. The microphone converts input speech into an electrical signal representing speech data. The analyzer converts the speech data into non-linear frequency converted speech data in accordance with a non-linear frequency conversion. The selector selects a coefficient of the non-linear frequency conversion suitable for each of the phonemes or frames of the speech. The memory stores the speech data.

26 Claims, 17 Drawing Sheets

FIG. 1B

| | | | | | | | |
|---|---|---|---|---|---|---|---|
| 1ST FRAME | $U/V_1$ | $pitch_1$ | $b^1(0)$ | $b^1(1)$ | ------ | $b^1(m_1)$ | $\alpha_1$ |
| 2ND FRAME | $U/V_2$ | $pitch_2$ | $b^2(0)$ | $b^2(1)$ | ------ | $b^2(m_2)$ | $\alpha_2$ |
| 3RD FRAME | $U/V_3$ | $pitch_3$ | $b^3(0)$ | $b^3(1)$ | ------ | $b^3(m_3)$ | $\alpha_3$ |
| | | | | | | | |
| iTH FRAME | $U/V_i$ | $pitch_i$ | $b^i(0)$ | $b^i(1)$ | ------ | $b^i(m_k)$ | $\alpha_i$ |
| | | | | | | | |
| nTH FRAME | $U/V_n$ | $pitch_n$ | $b^n(0)$ | $b^n(1)$ | ------ | $b^n(m_l)$ | $\alpha_n$ |

FIG. 1D

| α | P |
|---|---|
| 0.21 | 30 |
| ------- | ------- |
| 0.33 | 18 |
| 0.35 | 16 |
| 0.37 | 14 |
| ------- | ------- |
| 0.49 | 10 |

FIG. 1E ( NO. OF STAGES IN FILTER : 30 )

| | | | | | | | | | | | |
|---|---|---|---|---|---|---|---|---|---|---|---|
| i | $U/V_i$ | $Pitch_i$ | $b^i(0)$ | $b^i(1)$ | $b^i(2)$ | -------- | $b^i(16)$ | $\phi$ | $\phi$ | $\phi$ | $\alpha=0.35$ |
| i+1 | $U/V_{i+1}$ | $Pitch_{i+1}$ | $b^{i+1}(0)$ | $b^{i+1}(1)$ | $b^{i+1}(2)$ | ---------- | | $b^{i+1}(17)$ | $b^{i+1}(18)$ | $\phi$ | $\alpha=0.33$ |

| | SAUCE PARAMETER | | FILTER COEFFICIENTS | | | |
|---|---|---|---|---|---|---|
| 1ST FRAME | U/V | Pitch | $b^1(0)$ | $b^1(1)$ | | $b^1(m)$ |
| 2ND FRAME | | | $b^2(0)$ | $b^2(1)$ | | $b^2(m)$ |
| iTH FRAME | U/V | Pitch | $b^i(0)$ | $b^i(1)$ | | $b^i(m)$ |
| nTH FRAME | U/V | Pitch | $b^n(0)$ | $b^n(1)$ | | $b^n(m)$ |

FIG. 6

| | P | α |
|---|---|---|
| c | 30 | 0.21 |
| c | 30 | 0.21 |
| j | 28 | 0.23 |
| j | 26 | 0.25 |
| j | 23 | 0.28 |
| j | 20 | 0.31 |
| j | 18 | 0.33 |
| a | 16 | 0.35 |
| a | 16 | 0.35 |

FIG. 7A

| Pitch ⇓ | α ⇓ |
|---|---|
| 300 | 0.23 |
| 280 | 0.26 |
| 260 | 0.29 |
| 240 | 0.32 |
| 220 | 0.35 |
| ⋮ | ⋮ |
| 100 | 0.45 |

FIG. 7B

| b(0) ⇓ | α ⇓ |
|---|---|
| 7.0 | $\alpha_a - 0.3$ |
| 6.0 | $\alpha_a - 0.3$ |
| 5.0 | $\alpha_a - 0.3$ |
| 4.0 | $\phi$ |
| 3.0 | $\alpha_a + 0.3$ |
| 2.0 | $\alpha_a + 0.3$ |

$$\alpha\,wave = A\cos((w+\Delta w)t+\zeta)+\alpha_a$$

($\alpha_a$ ; $\alpha$ UPON ANALYSIS)

( A = 0.1 )

( $\zeta$ ; $\phi$ )

( $\Delta w$ ; VARIABLE )

METHOD AND APPARATUS FOR PROCESSING SPEECH

This application is a continuation of application Ser. No. 08/073,981 filed Jun. 8, 1993, now abandoned, which was a continuation of application Ser. No. 07/599,882, filed Oct. 19, 1990, now abandoned.

BACKGROUND OF THE INVENTION

1. Field of the Invention

The present invention relates to method and apparatus for processing a speech and, more particularly, to speech processing method and apparatus which can synthesize speech by a synthesized speech of a high quality and can synthesize speech by changing a voice quality.

2. Related Background Art

FIG. 2 shows a fundamental construction of a speech synthesizing apparatus. Generally, a speech producing model comprises: a sound source section which is constructed by an impulse generator 2 and a noise generator 3; and a synthesis filter 4 which expresses the resonance characteristics of a voice path indicative of a feature of a phoneme. A synthesis parameter memory 1 to send parameters to the sound source section and the synthesis filter is constructed as shown in FIG. 3. Speech is analyzed on the basis of an analysis window length of about a few seconds to tens of milli-seconds. The result of the analysis obtained for a time interval from the start of the analysis of a certain analysis window until the start of the analysis of the next analysis window is stored into the synthesis parameter memory 1 as data of one frame. The synthesis parameters comprise: sound source parameters indicative of a sound pitch and a voice/unvoice state; and synthesis filter coefficients. Upon synthesis, the above synthesis parameters of one frame are output at an arbitrary time interval (ordinarily, at a predetermined time interval; an arbitrary time interval when the interval between the analysis windows is changed), thereby obtaining a synthesized speech. Speech analysis methods such as PARCOR, LPC, LSP, format, cepstrum, and the like have conventionally been known.

Among the above analysis/synthesis methods, it is considered nowadays that the LSP method and the cepstrum method have the highest synthesis qualities. According to the LSP method, although the corresponding relation between the spectrum envelope and the articulation parameter is good, the parameters are based on the full pole model in a manner similar to the PARCOR method. Therefore, if the LSP method is used for a rule synthesis or the like, it is considered that a slight problem occurs. On the other hand, in the cepstrum method, a cepstrum which is defined by the Fourier coefficients of a logarithm spectrum is used for a synthesis filter coefficient. According to the cepstrum method, if a cepstrum is obtained by using envelope information of a logarithm spectrum, the quality of the synthesized speech is very high. In addition, different from a linear predicting method, since the cepstrum method is of the pole zero type in which the orders of the denominator and numerator of a transfer function are the same, the interpolating characteristics are good and such a cepstrum is also suitable as a synthesis parameter of a rule synthesizer.

However, in the ordinary cepstrum, it is necessary to set the analysis order to a high order in order to output a synthesized speech of a high quality. However, if the analysis order is raised, the capacity of the parameter memory increases, so that this method is not preferred. Therefore, if the parameters at a high frequency are thinned out in accordance with the resolution of the frequency of the auditory sense of a human being (the resolution is high at a low frequency and is low at a high frequency) and the extracted parameters are used, the memory can be efficiently used. The thinning-out process of the parameters according to the frequency resolution of the auditory sense of the human being is executed by frequency converting into the ordinary cepstrum by using a mel scale. The mel cepstrum coefficient obtained by frequency converting the cepstrum coefficient by using the mel scale is defined by the Fourier coefficient of the logarithm spectrum in a non-linear frequency memory.

The mel scale is a non-linear frequency scale indicative of the frequency resolution of the auditory sense of the human being which was estimated by Stevens. Generally, the scale which was approximately expressed by the phase characteristics of an all-pass filter is used.

A transfer function of the all-pass filter is expressed by $$\tilde{Z}^{-1}=(Z^{-1}-\alpha)/(1-\alpha Z^{-1}) \quad |\alpha|<1 \tag{1}$$

and its phase characteristics are as follows.

$$\tilde{Z}=e^{j\tilde{\Omega}}, \quad z=e^{j\Omega}$$
$$\tilde{\Omega}=2\pi\tilde{f}T, \quad \Omega=2\pi fT$$

where, $\Omega$, f, and T denote a standardized angular frequency, a frequency, and a sampling period, respectively. When the sampling frequency is set to 10 kHz, it is possible to convert into the frequency which is almost close to the mel scale by setting $\alpha=0.35$.

FIG. 4 shows a flowchart for extraction of a mel cepstrum parameter. FIG. 5 shows a state in which the spectrum was mel converted. FIG. 5A shows a logarithm spectrum after completion of the Fourier transformation. FIG. 5B shows a spectrum envelope which passes through the peaks of a smoothed spectrum and a logarithm spectrum. FIG. 5C is a diagram showing the case where the spectrum envelope in FIG. 5B was non-linearly frequency converted by using the equation (1) in which $\alpha=0.35$ and the frequency resolution of a low sound was raised. Since the $\Omega$ scale in each of FIGS. 5B and 5C has been set to regular intervals, the spectrum envelope curve is enlarged at a low frequency and is compressed at a high frequency. Hitherto, the value of $\alpha$ has been fixed on the synthesizer side and the sound source parameters and the synthesis filter coefficients shown in FIG. 3 have been sent from the synthesis parameter memory 1.

According to the method in which the mel frequency was approximated, although the parameters can be efficiently compressed, since the high frequency range in the frequency region is compressed, it is considered that such a method is not preferable to synthesize a female voice having a feature in a high frequency range. On the other hand, even for a low voice like a male voice, in the case where a speech element such as "cha", "chu", "cho", "hya", "hyu", or "hyo" having a feature of the speech in a relatively high frequency range was synthesized or the like, there is a tendency such that the clearness of a consonant part thereof deteriorates.

SUMMARY OF THE INVENTION

It is an object of the invention to provide a speech processing apparatus which can improve the clearness of a consonant part of speech and can synthesize speech of a high quality.

Another object of the invention is to provide a speech processing apparatus which can change the tone of a speech by merely converting a compressibility valve of speech.

In order to compress each of the phonemes comprising speech by the optimum value, the invention has means for extracting a value in which the compressibility, as a coefficient of a non-linear transfer function when speech information is compressed is made correspond to each phoneme.

To change the tone of a speech, the invention has means for converting the compressibility valve upon analysis and synthesizing of the speech.

BRIEF DESCRIPTION OF THE DRAWINGS

FIG. 1B is a diagram showing a data structure in a synthesis parameter memory in FIG. 1A;

FIG. 1D is a diagram showing a table structure to refer to the order of a cepstrum coefficient by the value of $\alpha_i$;

FIG. 1E is a diagram showing the case where ø was inserted into data when interpolating the portion between the frames having different orders in FIG. 1B;

FIG. 6 is a diagram showing an example in which the order of a synthesis parameter for a phoneme and the value of $\alpha$ were made correspond in order to improve the clearness of the consonant part;

FIG. 7A is a diagram of a table to convert the value of $\alpha$ by a pitch;

FIG. 7B is a diagram of a table to convert the value of $\alpha$ by a power term;

DETAILED DESCRIPTION OF THE PREFERRED EMBODIMENTS

(Embodiment 1)

Figure 1A:
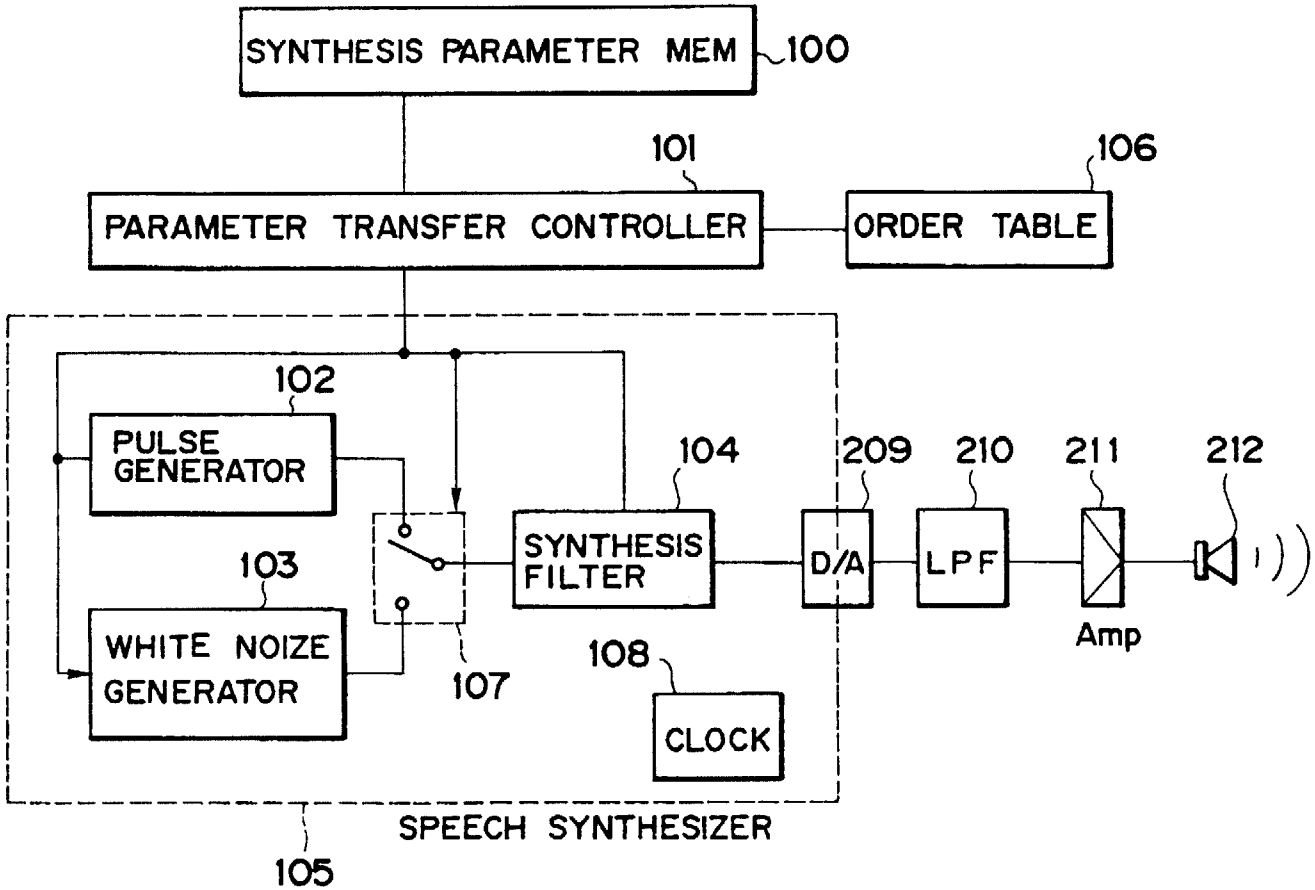
FIG. 1A is an arrangement diagram of a speech synthesizing apparatus showing a principal embodiment of the invention.
Figure 1C:
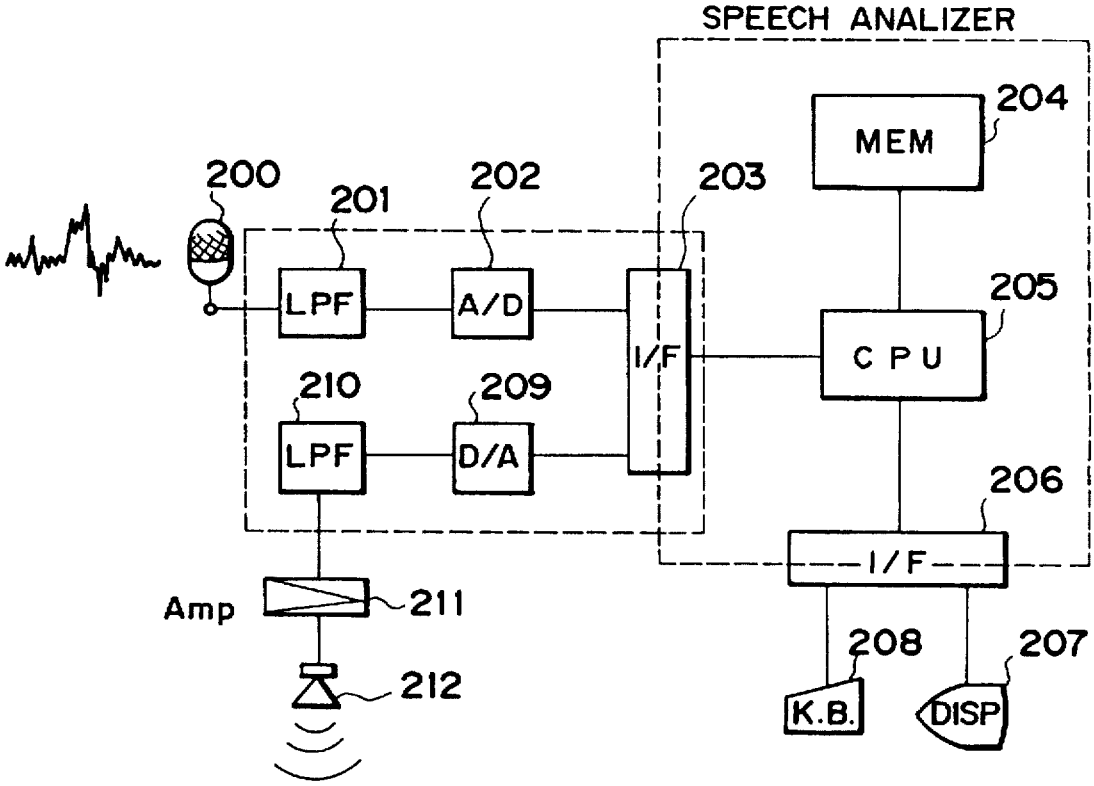
FIG. 1C is a system constructional diagram showing a principal embodiment of the invention.

FIG. 1 shows a constructional diagram of an embodiment. FIG. 1A is a constructional diagram of a speech synthesizing apparatus; FIG. 1B is a diagram showing a data structure in a synthesis parameter memory; and FIG. 1C is a system constructional diagram of the whole speech synthesizing apparatus. The flow of the operation will be described in detail in accordance with flowcharts of FIGS. 10 and 11. In the system constructional diagram shown in FIG. 1C, a speech waveform is input from a microphone 200. Only the low frequency component is allowed to pass by a LPF (low pass filter) 201. An analog input signal is converted into a digital signal by an A/D (analog/digital) converter 202. The digital signal is transmitted through: an interface 203 to execute the transmission and reception with a CPU 205 to control the operation of the whole apparatus in accordance with programs stored in a memory 204; an interface 206 to execute the transmission and reception among a display 207, a keyboard 208, and the CPU 205; a D/A (digital/analog) converter 209 to convert the digital signal from the CPU 205 into the analog signal; an LPF 210 for allowing only the low frequency component to pass; and an amplifier 211. Thus, a speech waveform is output from a speaker 212.

Figures 2, 3:
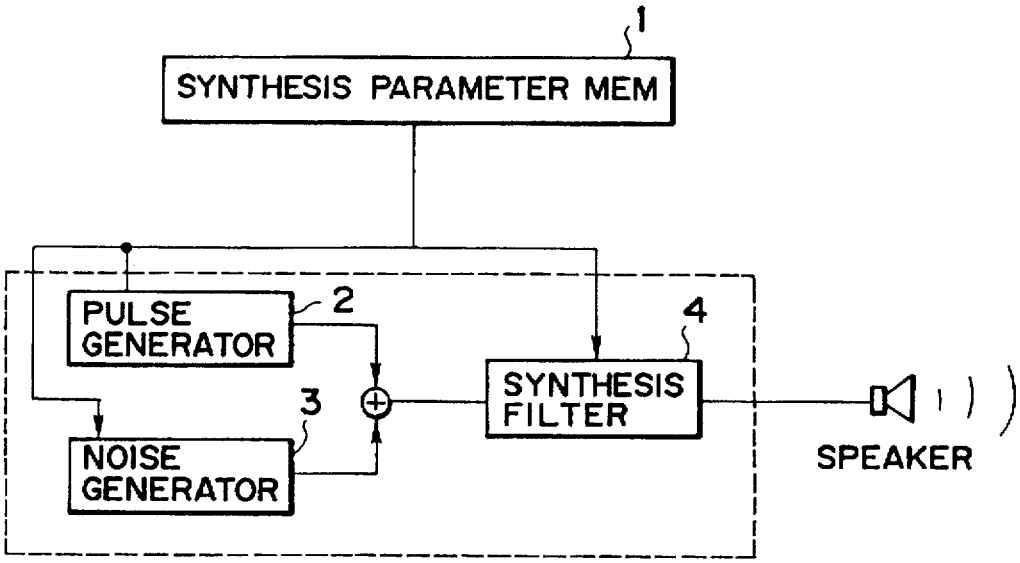
FIG. 2 is a constructional diagram of a conventional speech synthesizing apparatus.
FIG. 3 is a diagram showing a data structure in a conventional synthesis parameter memory.
Figure 4:
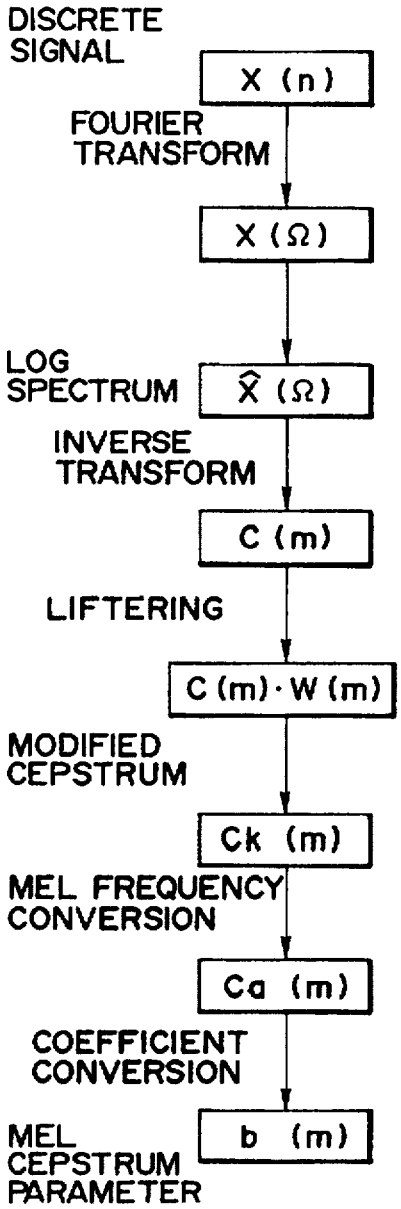
FIG. 4 is a flowchart for extraction and analysis of a synthesis parameter to execute a non-linear frequency conversion.
Figure 5A:
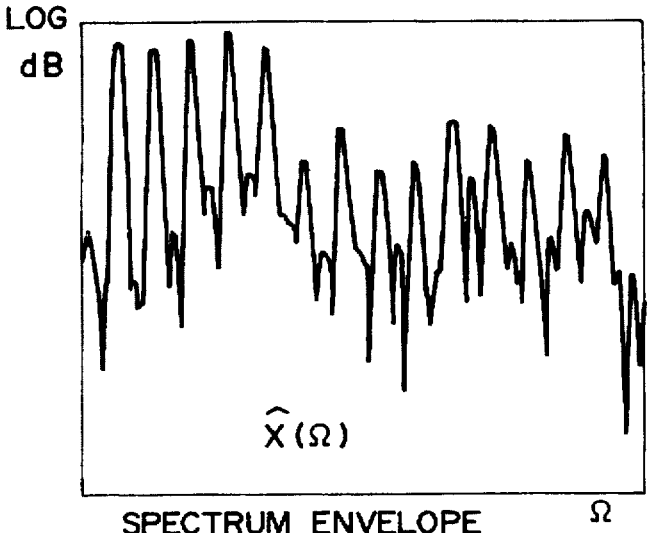
FIG. 5A is a diagram of a logarithm spectrum in FIG. 4.
Figure 5B:
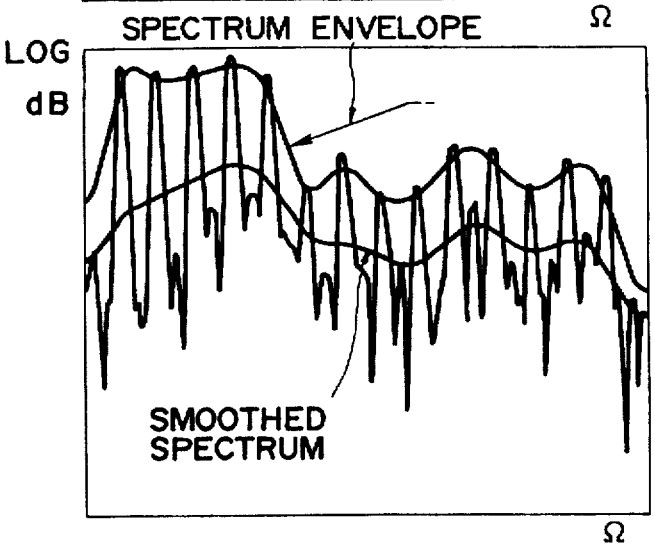
FIG. 5B is a diagram of a spectrum envelope obtained by an improved cepstrum method in FIG. 4.
Figure 5C:
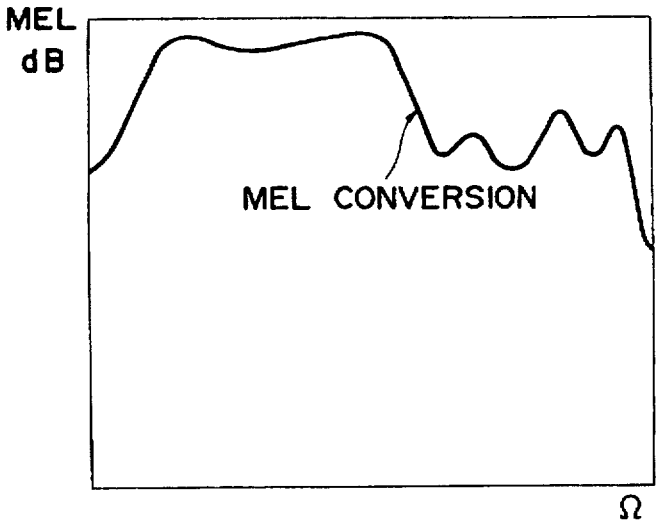
FIG. 5C is a diagram showing the result in the case where a non-linear frequency conversion was executed to the spectrum envelope in FIG. 5B.
Figure 10A:
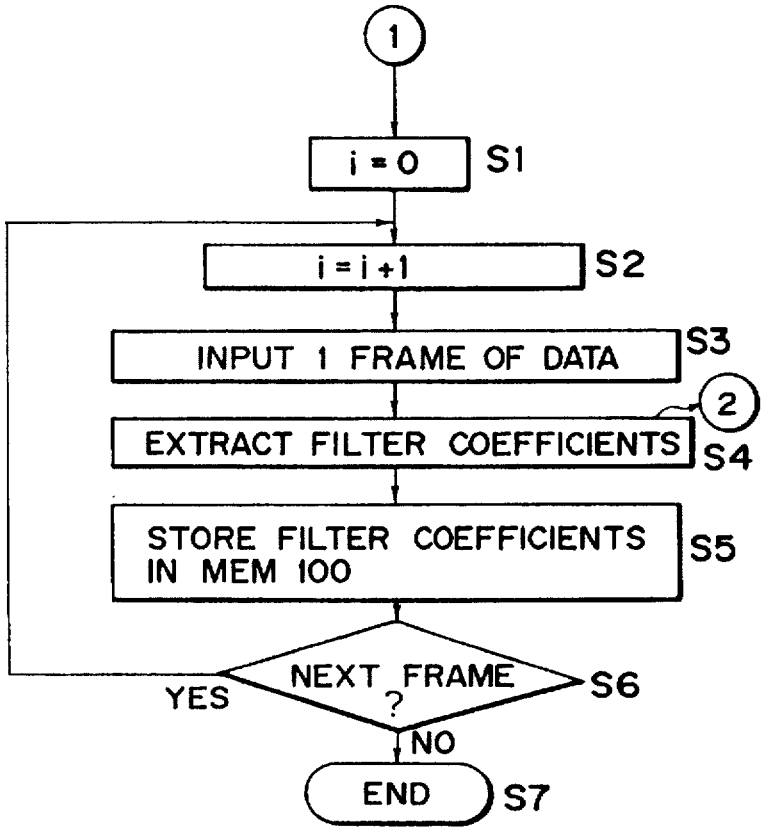
FIG. 10A is a main flowchart showing the flow for speech analysis.
Figure 10B:
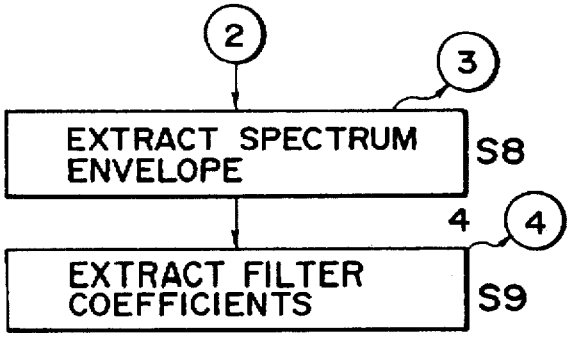
FIG. 10B is a flowchart showing the analysis of a speech and the extraction of synthesis filter coefficients in FIG. 10A.
Figure 10C:
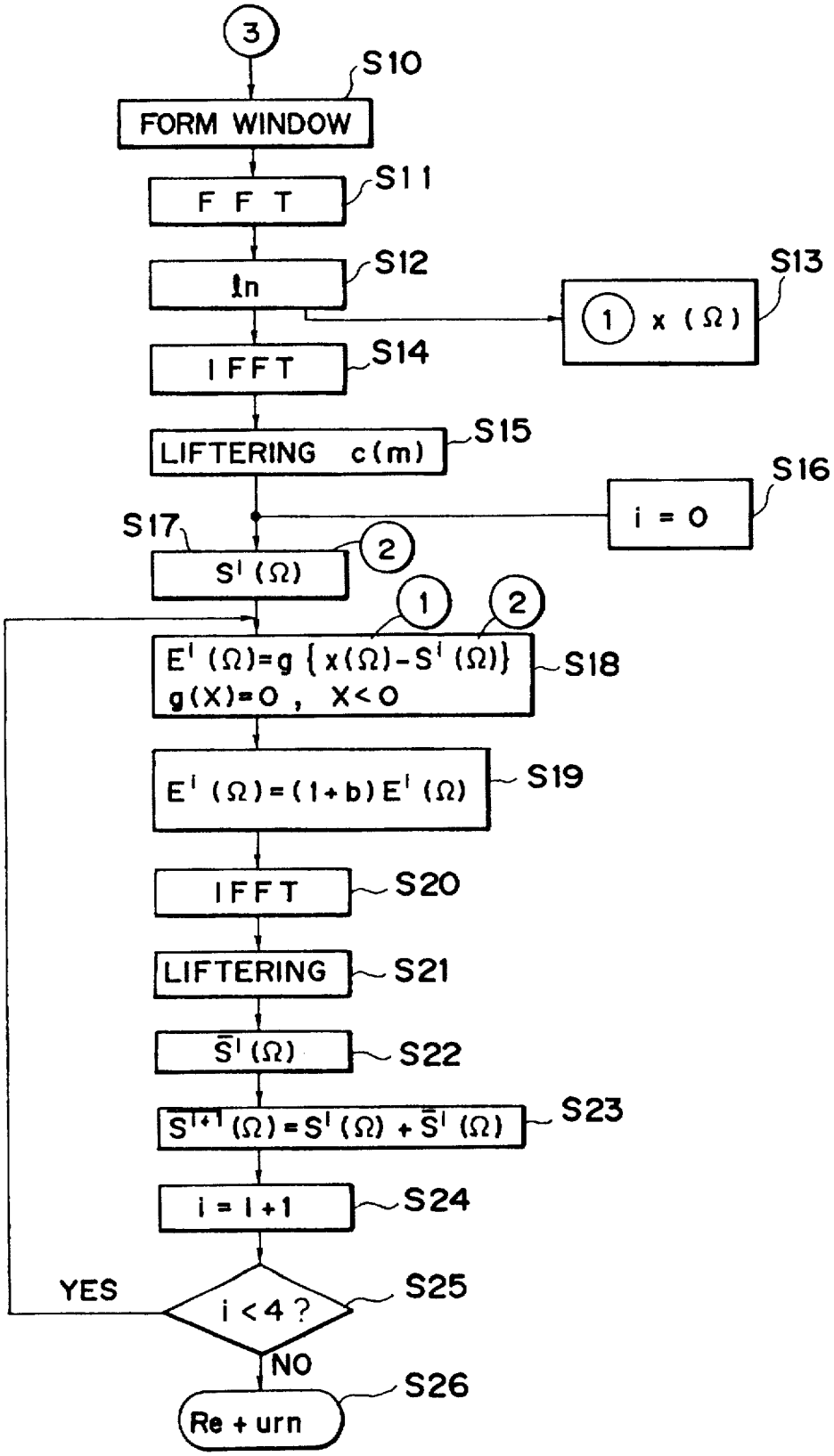
FIG. 10C is a flowchart for extraction of a spectrum envelope of a speech input waveform in FIG. 10B.
Figure 10D:
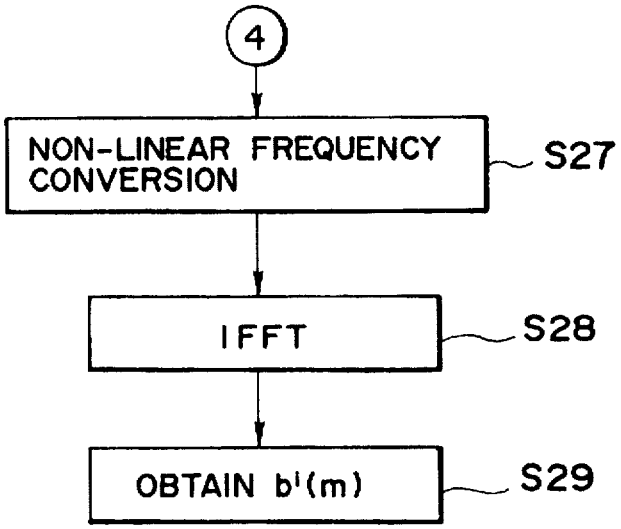
FIG. 10D is a flowchart showing the extraction of synthesis filter coefficients of a speech in FIG. 10B.

In a manner similar to the conventional speech synthesizing apparatus shown in FIG. 2, the synthesizing apparatus in FIG. 1A is constructed such that the speech waveform which was input from the microphone 200 is analyzed by the CPU 205, and the data as a result of the analysis is transferred one frame by one at a predetermined frame period interval from a synthesis parameter memory 100 to a speech synthesizer 105 by a synthesis parameter transfer controller 101. The flow of the operation to analyze speech is shown in the flowchart of FIG. 10 and will be explained in detail. FIG. 10A is a main flowchart showing the flow for the speech analysis. FIG. 10B is a flowchart showing the flow for the analyzing operation of a speech and the extracting operation of synthesis filter coefficients. FIG. 10C is a flowchart showing the flow for the extracting operation of a spectrum envelope of a speech input waveform. FIG. 10D is a flowchart showing the flow for the extracting operation of synthesis filter coefficients of speech. For the input speech waveform, the waveform obtained for a time interval from a time point when the analysis of a certain analysis window was started until the analysis of the next analysis window is started is set to one frame. The input speech waveform is analyzed and synthesized on a frame unit basis hereinafter. In the flowchart shown in FIG. 10, a frame number i is first set to 0 (step S1). Then, the frame number is updated (S2). The data of one frame is input to the CPU 205 (S3), by which the speech input waveform is analyzed and the synthesis filter coefficients are extracted (S4). To analyze the speech and to extract the synthesis filter coefficients, a spectrum envelope of the speech input waveform is extracted (S8) and the synthesis filter coefficients are extracted (S9). An extracting routine of the spectrum envelope is shown in the flowchart of FIG. 10C. First, a certain special window is formed for the input speech waveform in order to regard the data of one frame length as a signal of a finite length (S10). Then, the input speech waveform is subjected to a Fourier transformation (S11), a logarithm is calculated (S12), and the logarithm value is stored as a logarithm spectrum $X(\Omega)$ in a storage buffer in the memory 204 (S13). Then, an inverse Fourier transformation is executed (S14) and the resultant value is set to a cepstrum coefficient C(n). To smooth the cepstrum coefficient C(n), it is cut out at a certain special window (liftering) (S15). The frame number i in FIG. 10C is set to 0 (S16). The result obtained by executing the Fourier transformation is set to a smoothed spectrum $S^i(\Omega)$ (S17). The smoothed spectrum $S^i(\Omega)$ is subtracted from $X(\Omega)$ held in the storage buffer and the negative value is deleted. The result is set to a residual spectrum $E^i(\Omega)$ (S18). $E^i(\Omega)=(1+b)E^i(\Omega)$ is calculated with respect to a proper acceleration coefficient b (S19). Further, to obtain a smoothed spectrum $\overline{S^i}(\Omega)$ of $E^i(\Omega)$, the inverse Fourier transformation (S20), the liftering (S21), and the Fourier transformation (S22) are executed. $\overline{S^i}(\Omega)+\overline{S^i}(\Omega)$ is set to $\overline{S^{i+1}}(\Omega)$ (S23). i is replaced to i+1 (S24). The processes in steps S18 to S24 are repeated until i is equal to 4 (S25). When i is equal to 4 (S24), the value of $\overline{S^{i+1}}(\Omega)$ is set to a spectrum envelope $\hat{S}(\Omega)$. It is proper to set i to a value from 3 to 5. The extracting routine of the synthesis filter coefficients is shown in the flowchart of FIG. 10D. The spectrum envelope $\hat{S}(\Omega)$ obtained in the flowchart of FIG. 10C is converted into a mel frequency as frequency characteristics of the auditory sense. The phase characteristic of the all-pass filter which approximately expresses the mel frequency has been shown in the equation (2). An inverse function of the phase characteristic is shown in the following equation (3). A non-linear frequency conversion is executed by the equation (3) (S27).

$$\Omega=\Omega-2\tan^{-1}\{\alpha-\sin\Omega/(1+\alpha\cdot\cos\tilde{\Omega})\} \quad (3)$$

Label information (phoneme symbol corresponding to the waveform) is previously added to the waveform data and the value of $\alpha$ is determined on the basis of the label information. The spectrum envelope after the non-linear frequency conversion is obtained and is subjected to the inverse Fourier transformation (S28), thereby obtaining a cepstrum coefficient Ca(m). Filter coefficients $b^i(m)$ (i: frame number, m: order) are obtained by the following equation (4) by using the cepstrum coefficient Ca(m) (S29).

$$b^i(m)=Ca(m)+b(Ca(m-1)-b(m+1)) \quad (4)$$

Figure 11A:
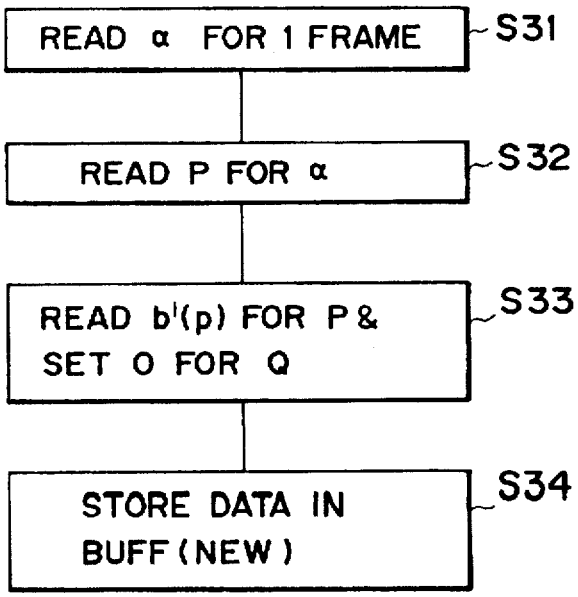
FIG. 11A is a flowchart showing the synthesis of a speech in the case where an order conversion table exists.

The filter coefficients $b^i(m)$ obtained are stored in the synthesis parameter memory 100 in the memory 204 (S5). FIG. 1B shows a structure of the synthesis parameter memory 100. As synthesis parameters of one frame of the frame number i, there is the value of a frequency conversion ratio $\alpha_i$ in addition to U/Vi (Voice/Unvoice) discrimination data, information regarding a rhythm such as a pitch and the like, and filter coefficients $b^i(m)$ indicative of a phoneme. The value of the frequency conversion ratio $\alpha_i$ is the optimum value which was made correspond to each phoneme by the CPU 205 upon analysis of the speech input waveform. $\alpha_i$ is defined as an $\alpha$ coefficient of the transfer function of the all-pass filter shown in the equation (1) (i is a frame number). When the value of $\alpha$ is small, the compressibility is also small. When $\alpha$ is large, the compressibility is also large. For instance, $\alpha\approx0.35$ in the case of analyzing the voice speech of a male voice by the sampling frequency of 10 kHz. Even in the case of the same sampling period, particularly, in the case of the speech of a female voice, if the value of $\alpha$ is set to a slightly small value and the order of the cepstrum coefficient is increased, a voice sound having a high clearness like a female voice is obtained. The order of the cepstrum coefficient corresponding to the value of $\alpha$ is predetermined by the table shown in FIG. 1D which has preliminarily been formed. The synthesis parameter transfer controller 101 transfers the data only as to the order to the speech synthesizer 105 from the synthesis parameter memory 100 with reference to the table shown in FIG. 1D. At this time, if the interpolation data in which the present frame and the next frame were interpolated on sample unit basis is sent, a further good speech can be obtained. FIG. 11 is a flowchart showing the flow of the operation to synthesize speech. There is a case where the memory 204 has therein a conversion table 106 for making the frequency compressibility $\alpha_i$ correspond to the order of the cepstrum coefficient upon synthesis of speech and a case where the memory 204 does not have such a conversion table. FIG. 11A is a flowchart showing the flow of the synthesizing operation of a speech in the case where the memory 204 has the conversion table 106. First, the value of the frequency compressibility $\alpha$ of the data of one frame is read out of the synthesis parameter memory 100 in the memory 204 by the CPU 205 (S31). An order P of the cepstrum coefficient corresponding to $\alpha$ is read out of the order reference table 106 by the CPU 205 (S32). Data $b^i(P)$ of the filter coefficients of only the order P is read out of the synthesis parameter memory 100 by the CPU 205 and $\emptyset$ is inserted into the remaining portions of the frame data of the amount of the Qth order (30th order−Pth order=Qth order) (S33). The frame data formed is stored into a Buff (New) in the memory 204 (S34).

Figure 11B:
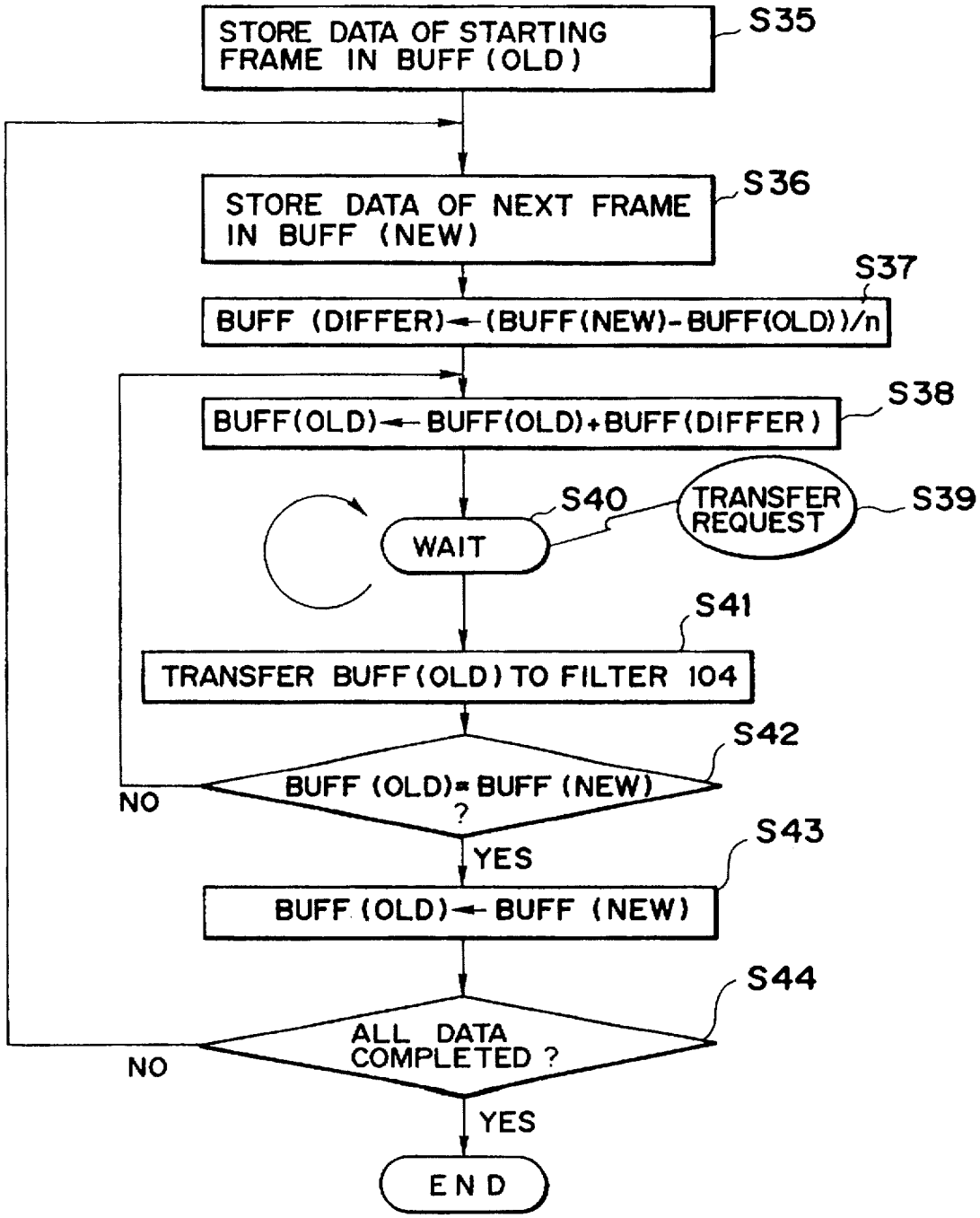
FIG. 11B is a flowchart for a synthesis parameter transfer control section.

FIG. 11B is a flowchart showing the flow of the speech synthesizing operation in the case where the memory 204 does not have the order reference table 106.

Figure 11C:
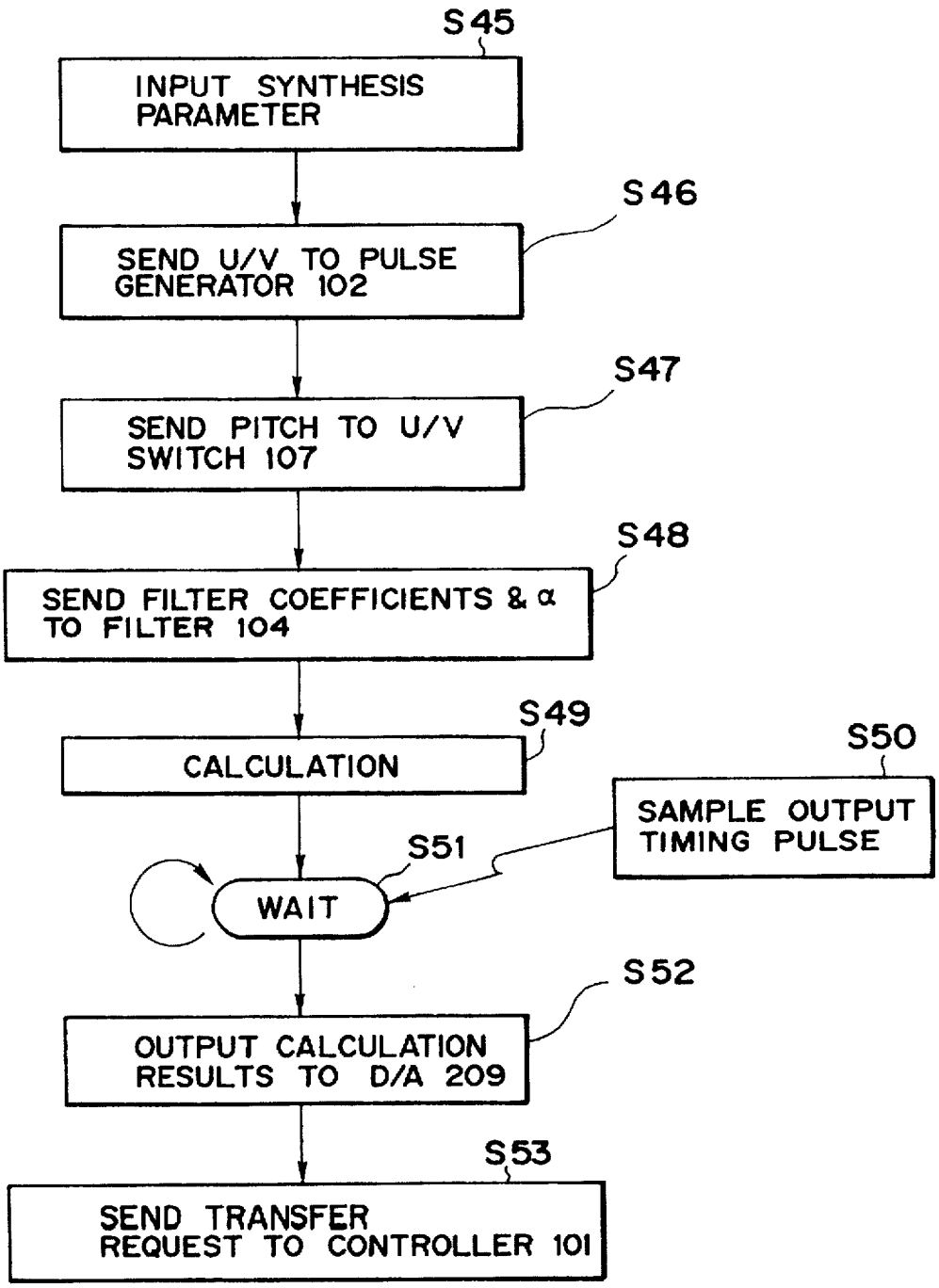
FIG. 11C is a flowchart showing the flow of the operation of a speech synthesizer.

FIG. 11B relates to the flow in which the synthesis parameter transfer controller 101 transfers the data to the speech synthesizer 105 while interpolating the data. First, the data of the start frame is input as present frame data into a Buff (old) from the synthesis parameter memory 100 in the memory 204 (S35). Next, the frame data of the next frame number is stored into a Buff (New) from the synthesis parameter memory 100 (S36). The value obtained by dividing the difference between the Buff (New) and the Buff (old) by the number n of samples to be interpolated is set to Buff (differ) (S37). The value obtained by adding Buff (differ) to the present frame data Buff (old) is set to the present frame data Buff (old) (S38). In this state, the apparatus waits (S40) until a transfer request is output from the speech synthesizer 105 (S39). If the transfer request has been generated, the present frame data Buff (old) is transferred to the synthesis filter 104 (S41). A check is made to see if the present frame data Buff (old) is equal to the next frame data Buff (New) or not (S42). If they differ, the processing routine is returned and the processes in steps S38 to S42 are repeated until Buff (old)=Buff (New). If it is determined in step S42 that Buff (old)=Buff (New), the Buff (New) is replaced as the present frame data Buff (old) (S43). A check is made to see if the transfer of all of the frame data in the synthesis parameter memory 100 has been completed or not (S44). If NO, the processing routine is returned and the processes in steps S36 to S44 are repeated until the data transfer is completed. FIG. 11C is a flowchart showing the flow of the operation in the speech synthesizer 105.

If a synthesis parameter has been input from the synthesis parameter transfer controller 101 to the speech synthesizer 105 (S45), the U/V data is sent to the pulse generator 102 (S46). The pitch data is sent to a U/V switch 107 (S47). The filter coefficients and the value of α are sent to a synthesis filter 104 (S48). In the synthesis filter 104, the calculation of a synthesis filter is calculated (S49). Even after the synthesis filter was calculated, the apparatus waits (S52) until a sample output timing pulse is output from a clock 108 (S51). If the sample output timing pulse has been generated (S51), the result of the calculation of the synthesis filter is output to the D/A converter 209 (S52). A transfer request is sent to the synthesis parameter transfer controller 101 (S53).

Figure 12:
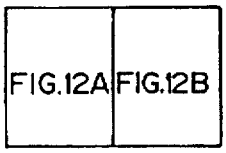
FIG. 12 is an arrangement diagram of a mel log spectrum approximation filter.
Figure 12A:
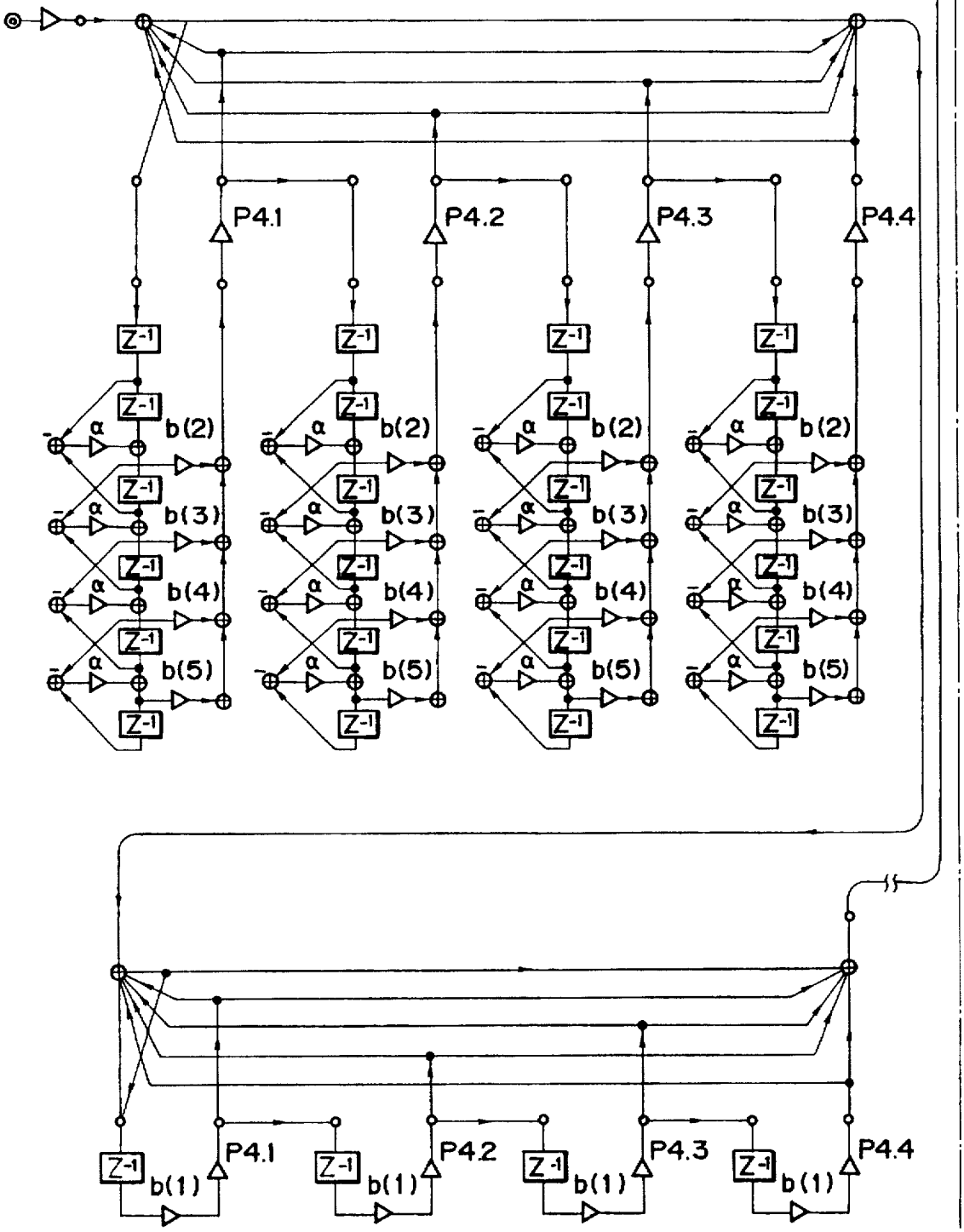
FIGS. 12A and 12B are schematic views of a mel log spectrum approximation filter.
Figure 12B:
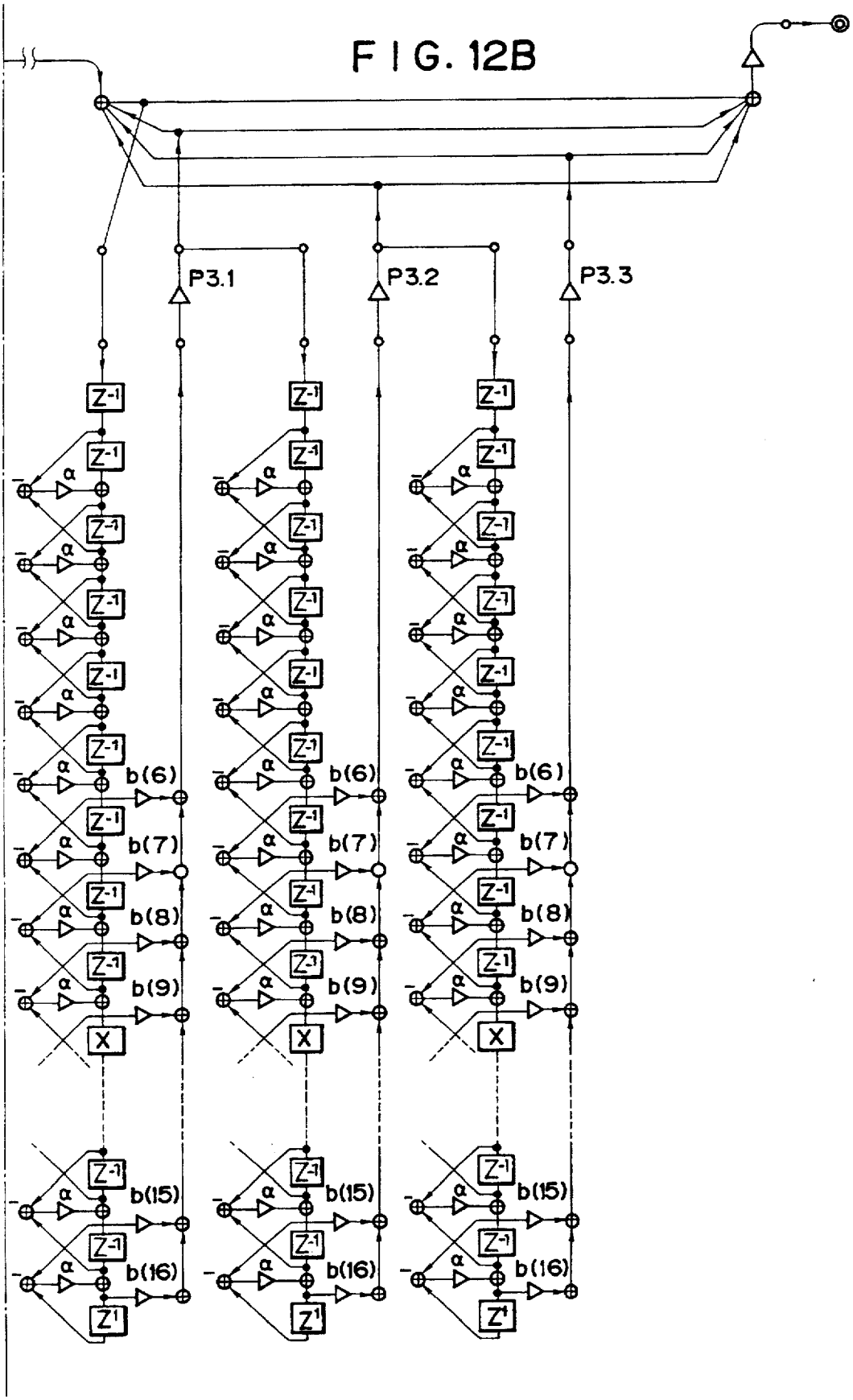

FIGS. 12A and 12B show a construction of an MLSA filter. FIGS. 12A and 12B show a filter having a transfer function represented by equations (5) and (6) below. The filter is formed using a 16-bit fixed decimal DSP (Digital Signal Processor) such that problems of the processing accuracy, which are inherently critical in making a synthesizer with such a 16-bit fixed decimal DSP, may be eliminated as much as possible. A transfer function of the synthesis filter 104 is expressed by $H(\tilde{Z})$ as follows.

$$H(+\tilde{i}\,\tilde{Z}+\tilde{I}) = exp\,(b(0)/2)\cdot R4(F(+\tilde{i}\,\tilde{Z}+\tilde{I})) \quad (5)$$

$$F(+\tilde{i}\,\tilde{Z}+\tilde{I}) = Z^{-1}\,(b(1)+b(2)+\tilde{i}\,\tilde{Z}+\tilde{I}^{-1}+b(3)+\tilde{i}\,\tilde{Z}+\tilde{I}^{-2}+\ldots+b(30)+\tilde{i}\,\tilde{Z}+\tilde{I}^{-31} \quad (6)$$

where, $R_4$ denotes an exponential function which was expressed by a quartic Padéapproximation. That is, the synthesis filter is of the type in which the equation (1) was substituted for the equation (5) and the equation (4) was substituted for the equation (6). By changing the frequency conversion ratio α and the order P of the coefficients which are given to the filter in the filter construction shown in equations (1), (4), and (5), the input speech is compressed by optimum frequency compressibility. A speech can be synthesized by the produced filter coefficients at the frequency expansion ratio corresponding to each frame.

In the embodiment, the frequency conversion has been performed by using a primary all-pass filter as shown in the equation (1). However, if a synthesis filter comprising a multiple order all-pass filter is used, the frequency can be compressed or expanded with respect to an arbitrary portion of the spectrum envelope obtained.

(Embodiment 2)

In the embodiment 1, a speech of a high quality has been synthesized by making the frequency compressibility a upon analysis and the order P of the filter coefficients correspond to α and P upon synthesis.

Figure 1F:
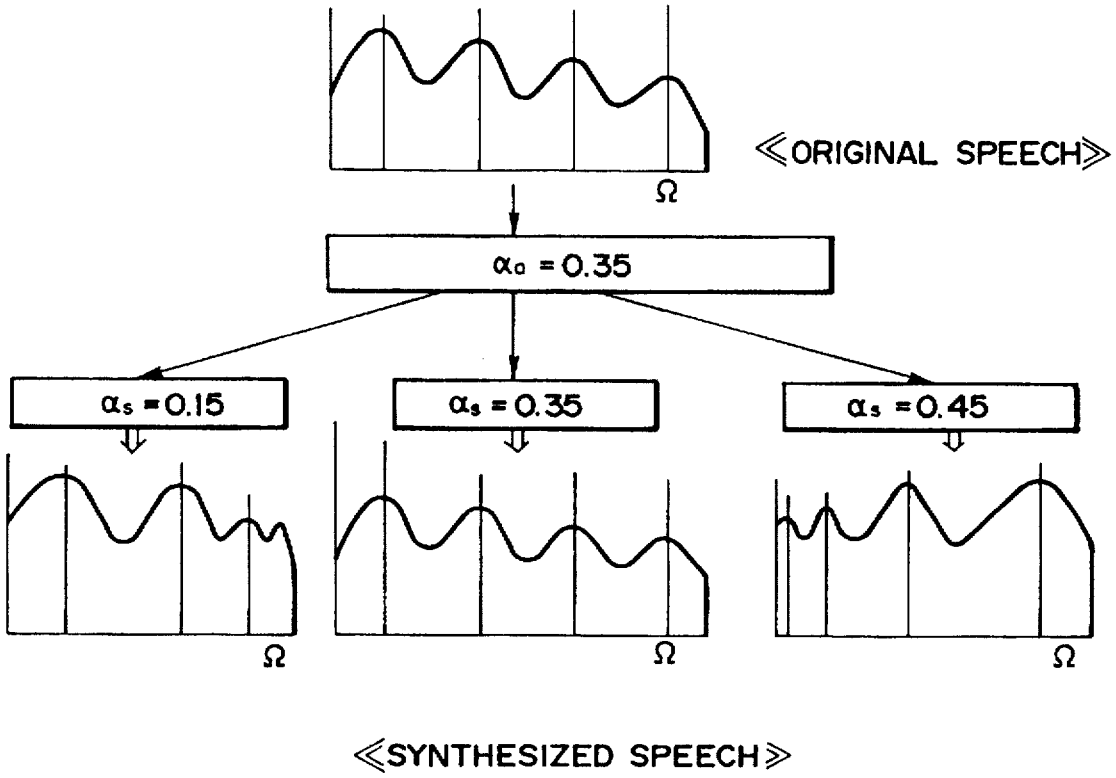
FIG. 1F is a spectrum diagram of an original sound and a synthesized speech in the case where the value of $\alpha$ is different upon analysis and synthesis.

In the embodiment, after the synthesis parameter which had been analyzed by setting the value of the frequency compressibility α to a constant value was converted by the synthesis parameter transfer controller 101, the converted synthesis parameter is transferred to the speech synthesizer 105, so that the sound quality (voice tone) is changed and the speech can be synthesized. FIG. 1F shows a state of a spectrum (included in one frame) in the case where the value of α was changed. The value of α upon analysis was set to $\alpha_a$=0.35 and the value of α upon synthesis was changed to $\alpha_s$=0.15, 0.35, and 0.45. If the speech was synthesized by executing a conversion such that $\alpha_s<\alpha_a$, a deep voice having weighted low frequency components is obtained. If $\alpha_s>\alpha_a$, a thin voice having weighted high frequency components is obtained.

As a method of converting the value of α, there are the following methods.

1. According to a first method, a conversion table to change the value of α is previously formed, and the value of α after completion of the conversion which was obtained by referring to the conversion table is used upon synthesis 2. According to a second after the value of α was changed by a linear or non-linear functional equation, the changed value of α is used The value of α upon analysis and the value of α upon synthesis are set to the same value and are made correspond, or the value after it was converted into a different value is made correspond. There are various corresponding methods. In the embodiment, those value have been made correspond on a frame unit basis. However, they can be also made correspond on the basis of a unit of a phoneme, a syllable, or a speaker.

To improve the clearness upon synthesis, for instance, in the case of /k/j/a/, it is most desirable to improve the clearness of the consonant part /k/ of "kja". Therefore, to improve the clearness upon analysis of the /k/ part, α is decreased and P is increased. For instance, the analysis is executed by setting such that α=0.21 and P≈30th order and the parameter is stored into the synthesis parameter memory 100. If the value of α is gradually increased for the /j/ part and α=0.35 and P=16th order for the /a/ part, the frame interpolation is also smoothly executed. FIG. 6 shows changes in the value of the frequency conversion ratio α Of each frame and the order of the coefficients which are given to the synthesis filter.

If the first method of changing the value of α by using the convertion table is used as a method when α upon analysis and α upon synthesis are changed, as shown in FIG. 7A, by designating the value of α in correspondence to the value of the pitch which is given to the synthesizer, a sound in which low frequency components were emphasized at a high pitch frequency is obtained and a sound in which high frequency components were emphasized at a low pitch frequency is derived. As shown in FIG. 7B, by making it correspond to b(0), a sound in which low frequency components were emphasized in the case of a large voice and a sound in which high frequency components were emphasized in the case of a small voice can be synthesized and the synthesized speech can be output.

Figures 8, 9:
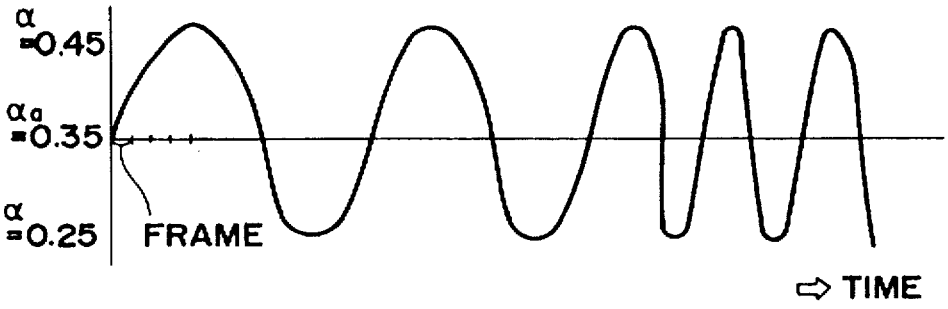
FIG. 8 shows an equation of the $\alpha$ modulation to change the voice quality of a speech.
FIG. 9 is a waveform diagram of $\alpha$ showing the state of modulation.

On the other hand, in the case of changing the value of α by the function as the above second method, for instance, the value of α upon analysis (α=0.35 and P=16th order in all of the frames for simplicity of explanation) can be set to the value which was modulated at a predetermined period upon synthesis. By providing means for inputting a modulating period and a modulating frequency (e.g., 0.35±0.1) to the synthesis parameter transfer controller 101 in FIG. 1A, the spectrum distribution of the input voice is modulated in a time-dependent manner and a speech different from the input speech can be output. FIG. 8 shows the equation of the α modulation and FIG. 9 shows a state of the α modulation.

Any one of the α modulating methods based on the amplitude, frequency, phase can be used. With respect to the modulating method, the value of the amplitude information of a speech (in the embodiment, b(0): filter coefficients of the 0th order term) can be also made correspond to the value of α. For instance, the value of b(0) of the synthesis filter can be also changed by setting such that $b^n(0)=(\alpha-0.35+1)\cdot b^o(0)$ ($b^o(0)$; old b(0) $B^n(0)$; new b(0)) by using the value of α shown in FIG. 9.

With regard to the pitch as well, it is possible to make correspond such that $Pitch^n=(\alpha-0.35+1)\cdot Pitch^o$ ($Pitch^o$: old; $Pitch^n$: new). On the contrary, the value of α can be also changed by using the power term and the value of the pitch.

According to the invention, the following technical advantages are obtained by the above construction.

By providing the means for setting the compressibility as a coefficient of a non-linear transfer function when speech information is compressed to the value corresponding to each of the phonemes constructing a speech, the phonemes are compressed by the optimum value, respectively. Thus, the clearness of the consonant part is improved and the speech of a high quality can be synthesized.

By using the method whereby the compressibility as a coefficient of the non-linear transfer function when speech information is compressed is set to the value corresponding to each of the phonemes constructing a speech, the phonemes are compressed by the optimum value, respectively. Thus, the clearness of the consonant part is improved and the speech of a high quality can be synthesized.

By providing the means for converting the compressibility upon speech analysis and the means for synthesizing a speech by using the converted compressibility, a voice tone of a speech can be changed by merely converting the compressibility.

By using the method of converting the compressibility upon speech analysis and the method of synthesizing a speech by using the converted compressibility, the voice tone of a speech can be changed by merely converting the compressibility.

We claim:

1. A speech processing apparatus comprising:

input means for inputting speech data;

means for identifying types of phonemes for every frame comprising the speech data inputted by said input means;

means for changing a value of a frequency conversion ratio of a non-linear frequency conversion to be suitable for the frequency characteristic of each of the types of the phonemes identified by said identifying means for every frame; and memory means for storing a parameter corresponding to the input speech data frame-by-frame, the parameter including (a) the value of the frequency conversion ratio of the non-linear frequency conversion changed to correspond to the frequency characteristic of each phoneme identified for every frame and (b) filter coefficients indicative of the frame.

2. An apparatus according to claim 1, wherein said changing means converts the speech according to the non-linear frequency conversion expressed by $$Z^{-1}=(Z^{-1}-\alpha)/(1-\alpha Z^{-1}).$$

3. An apparatus according to claim 2, further comprising means for obtaining a frequency resolution which is close to a frequency resolution of an auditory sense of a human being by adjusting the filter coefficients of the non-linear frequency conversion.

4. A method for processing input speech comprising the steps of:

inputting speech data;

identifying types of phonemes for every frame comprising the speech data inputted by said inputting step;

changing a value of a frequency conversion ratio of a non-linear frequency conversion to be suitable for the frequency characteristic of each of the types of the phonemes identified by said identifying step for every frame; and storing a parameter corresponding to the input speech data frame-by-frame, the parameter including (a) the value of the frequency conversion ratio of the non-linear frequency conversion changed to correspond to the frequency characteristic of each phoneme identified for every frame and (b) filter coefficients indicative of the frame.

5. A method according to claim 4, wherein said changing step comprises the step of converting the input speech data into non-linear frequency converted speech data in accordance with a non-linear frequency conversion expressed by $$Z^{-1}=(Z^{-1}-\alpha)/(1-\alpha Z^{31\ 1}).$$

6. A method according to claim 5, further comprising a step of obtaining a frequency resolution which is close to a frequency resolution of an auditory sense of a human being by adjusting the filter coefficients of the non-linear frequency conversion.

7. A method according to claim 5, further comprising a step of synthesizing speech from the non-linear frequency converted speech data using a logarithm spectrum approximation filter which is constructed by using a primary all-pass filter as a delay element.

8. A speech processing apparatus comprising:

memory means for storing a parameter including a value of a frequency conversion ratio and filter coefficients;

first reading means for reading a value of a frequency conversion ratio of a non-linear frequency conversion for each frame from the parameter stored in said memory means;

second reading means for reading speech data of an order specified in accordance with the value of the frequency conversion ratio read by said first reading means;

converting means for converting the read speech data into non-linear frequency converted speech information in accordance with the read value of the frequency conversion ratio of the non-linear frequency conversion; and synthesizing means for synthesizing speech in accordance with the non-linear frequency conversion and the filter coefficients read from the parameter stored in said memory means.

9. An apparatus according to claim 8, wherein said synthesizing means synthesizes speech in accordance with the non-linear frequency conversion expressed by $$Z^{-1}=Z^{-1}-\alpha)/(1-\alpha Z^{-1}).$$

10. An apparatus according to claim 9, further comprising means for obtaining a frequency resolution which is close to a frequency resolution of an auditory sense of a human being by adjusting a coefficient of the non-linear frequency conversion.

11. An apparatus according to claim 8, further comprising means for using a table or a functional equation for conversion of the read speech information.

12. An apparatus according to claim 8, wherein said synthesizing means comprises a logarithm spectrum approximation filter which is constructed by using a primary all-pass filter as a delay element.

13. A method for processing speech information comprising the steps of:

storing a parameter including a value of a frequency conversion ratio and filter coefficients;

reading a value of a frequency conversion ratio of a non-linear frequency conversion for each frame from the parameter stored in said storing step;

reading speech data of an order specified in accordance with the value of the frequency conversion ratio read in said reading step;

converting the read speech data into nonlinear frequency converted speech information in accordance with the read value of the frequency conversion ratio of the non-linear frequency conversion; and synthesizing speech in accordance with the non-linear frequency conversion and the filter coefficients read from the parameter stored in said storing step.

14. A method according to claim 13, wherein said synthesizing step comprises the step of synthesizing speech in accordance with the non-linear frequency conversion expressed by $$Z^{-1}=(Z^{-1}-\alpha)/(1-\alpha Z^{-1}).$$

15. A method according to claim 14, further comprising a step of obtaining a frequency resolution which is close to a frequency resolution of an auditory sense of a human being by adjusting the filter coefficients of the non-linear frequency conversion.

16. A method according to claim 13, further comprising a step of using a table or a functional equation for conversion of the read speech information.

17. A method according to claim 13, wherein the synthesizing step comprises a step of using a logarithm spectrum approximation filter which is constructed by using a primary all-pass filter as a delay element.

18. A computer usable medium having computer readable program code means embodied therein for causing a computer to process input speech, said computer readable program code means comprising:

first means for causing the computer to input speech data;

second means for causing the computer to identify types of phonemes for every frame comprising the speech data caused to be input by said first means;

third means for causing the computer to change a value of a frequency conversion ratio of a non-linear frequency conversion to be suitable for the frequency characteristic of each of the types of the phonemes caused to be identified by said second means for every frame; and fourth means for causing the computer to store a parameter corresponding to the input speech data frame-by-frame, the parameter including (a) the value of the frequency conversion ratio of the non-linear frequency conversion changed to correspond to the frequency characteristic of each phoneme identified for every frame and (b) filter coefficients indicative of the frame.

19. A medium according to claim 18, wherein said third means comprises means for causing the computer to convert the input speech data into non-linear frequency converted speech data in accordance with a non-linear frequency conversion expressed by $$Z^{-1}=(Z^{-1}-\alpha)/(1-\alpha Z^{-1}).$$

20. A medium according to claim 19, wherein said computer readable program code means further comprises fifth means for causing the computer to obtain a frequency resolution which is close to a frequency resolution of an auditory sense of a human being by adjusting the filter coefficients of the non-linear frequency conversion.

21. A medium according to claim 18, wherein said computer readable program code means further comprises means for causing the computer to synthesize speech from the non-linear frequency converted speech data using a logarithm spectrum approximation filter which is constructed by using a primary all-pass filter as a delay element.

22. A computer usable medium having computer readable program code means embodied therein for causing a computer to process speech information, the computer readable program code means comprising:

first means for causing the computer to store a parameter including a value of a frequency conversion ratio and filter coefficients;

second means for causing the computer to read a value of a frequency conversion ratio of a non-linear frequency conversion for each frame from the parameter caused to be stored by said first means;

third means for causing the computer to read speech data of an order specified in accordance with the value of the frequency conversion ratio caused to be read by said second means;

fourth means for causing the computer to convert the read speech data into non-linear frequency converted speech information in accordance with the read value of the frequency conversion ratio of the non-linear frequency conversion; and fifth means for causing the computer to synthesize speech in accordance with the non-linear frequency conversion and the filter coefficients read from the parameter caused to be stored by said first means.

23. A medium according to claim 22, wherein said fifth means comprises means for causing the computer to synthesize speech in accordance with the non-linear frequency conversion expressed by $$Z^{-1}=(Z^{-1}-\alpha)/(1-\alpha Z^{-1}).$$

24. A medium according to claim 23, wherein said computer readable program code means further comprises means for causing the computer to obtain a frequency resolution which is close to a frequency resolution of an auditory sense of a human being by adjusting the filter coefficients of the non-linear frequency conversion.

25. A medium according to claim 22, wherein said computer readable program code means further comprises means for causing the computer to use a table or a functional equation for conversion of the read speech information.

26. A medium according to claim 22, wherein said fifth means comprises means for causing the computer to use a logarithm spectrum approximation filter which is constructed by using a primary all-pass filter as a delay element.

* * * * *

UNITED STATES PATENT AND TRADEMARK OFFICE

CERTIFICATE OF CORRECTION

PATENT NO. : 5,715,363
DATED : February 3, 1998
INVENTOR(S) : Junichi TAMURA, et al.

It is certified that error appears in the above-identified patent and that said Letters Patent is hereby corrected as shown below:

Title Page

[73] Assignee, delete "Kabushika" and insert therefor --Kabushiki--;
[56] References Cited, Other Publications, in the title of the publication by Oppenheim, et al., delete "P" and insert therefor --of--.

SHEET 1 OF THE DRAWINGS

Figure 1A, box 103, delete "NOIZE" and insert therefor --NOISE--.

SHEET 3 OF THE DRAWINGS

Figure 1C, delete "ANALIZER" and insert therefor --ANALYZER--.

SHEET 6 OF THE DRAWINGS

Figure 3, delete "SAUCE" and insert therefor --SOURCE--.

Column 1

Line 12, delete "a".

UNITED STATES PATENT AND TRADEMARK OFFICE

CERTIFICATE OF CORRECTION

PATENT NO. : 5,715,363
DATED : February 3, 1998
INVENTOR(S) : Junichi TAMURA, et al.

It is certified that error appears in the above-identified patent and that said Letters Patent is hereby corrected as shown below:

Column 2 after Line 21, insert the following line:
--$\tilde{\Omega} = \Omega + 2\tan^{-1}\{\alpha \cdot \sin\Omega/(1 - \alpha \cdot \cos\Omega)\}$ ...(2)--.
Line 25, delete "$\tilde{\Omega} = 2\pi f_T$" and insert therefor --$\tilde{\Omega} = 2\pi \tilde{f} T$--.
Line 66, delete "a".

Column 3

Lines 5 and 43, after "made " insert --to--.
Line 56, delete "a", second occurrence.

Column 5

Line 37, delete "$\Omega = \Omega - 2\tan^{-1}\{\alpha \cdot \sin\Omega/(1 + \alpha \cdot \cos\tilde{\Omega})\}$" and insert therefor --$\Omega = \tilde{\Omega} - 2\tan^{-1}\{\alpha - \sin\tilde{\Omega}/(1 + \alpha \cdot \cos\tilde{\Omega})\}$--.
Line 61, after "made", insert --to--.

UNITED STATES PATENT AND TRADEMARK OFFICE

CERTIFICATE OF CORRECTION

PATENT NO. : 5,715,363
DATED : February 3, 1998
INVENTOR(S) : Junichi TAMURA, et al.

It is certified that error appears in the above-identified patent and that said Letters Patent is hereby corrected as shown below:

Column 7

Line 21, formula (5), delete in its entirety and insert therefor:
--$H(\tilde{Z}) = \exp (b(0)/2) \cdot R4(F(\tilde{Z}))$--.
Lines 25 and 26, Formula (6), delete in its entirety and insert therefor:
--$F(\tilde{Z}) = Z^{-1} (b(1)+b(2)\tilde{Z}^{-1}+b(3)\tilde{Z}^{-2}+\ldots+b(30)\tilde{Z}^{-31}$--.
Line 28, delete "Padéapproximation" and insert therefor
--Padé approximation--.
Line 48, delete "a" and insert therefor --$\alpha$--.

Column 8

Line 4, after "synthesis", insert a period.
Line 7, after "used", insert a period.
Line 25, delete "Of" and insert therefor --of--.
Line 29, delete "convertion" and insert therefor --conversion--.

UNITED STATES PATENT AND TRADEMARK OFFICE

CERTIFICATE OF CORRECTION

PATENT NO. : 5,715,363
DATED : February 3, 1998
INVENTOR(S) : Junichi TAMURA, et al.

It is certified that error appears in the above-identified patent and that said Letters Patent is hereby corrected as shown below:

Column 10

Line 13, delete "$Z^{-1}=(Z^{-1}-\alpha)/(1-\alpha Z^{31\ 1})$" and insert therefor --$Z^{-1}=(Z^{-1}-\alpha)/(1-\alpha Z^{-1})$--.

Line 20, delete "5" and insert therefor --4--.

Signed and Sealed this

Seventeenth Day of November, 1998

*Attest:*

BRUCE LEHMAN

*Attesting Officer*

*Commissioner of Patents and Trademarks*